US009303538B2

(12) United States Patent
Bryde et al.

(10) Patent No.: US 9,303,538 B2
(45) Date of Patent: Apr. 5, 2016

(54) OIL PAN CASTING WITH OPTIONAL OIL COOLER PROVISIONS

(71) Applicant: GM Global Technology Operations LLC, Detroit, MI (US)

(72) Inventors: Steven G. Bryde, Davisburg, MI (US); Kevin Herrala, Grand Blanc, MI (US); Michael B. Fleck, Royal Oak, MI (US); Michael S. Ferrand, Harrison Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 287 days.

(21) Appl. No.: 14/049,384

(22) Filed: Oct. 9, 2013

(65) Prior Publication Data

US 2015/0096841 A1 Apr. 9, 2015

(51) Int. Cl.
*B22D 17/00* (2006.01)
*F01M 11/00* (2006.01)

(52) U.S. Cl.
CPC ..... *F01M 11/0004* (2013.01); *B22D 17/00* (2013.01); *F01M 2011/0025* (2013.01); *F01M 2011/0029* (2013.01)

(58) Field of Classification Search
CPC ..... B22D 17/00; F01M 11/0004
USPC ..... 164/113, 137, 303–318, 339–343; 123/195 C
See application file for complete search history.

(56) References Cited

U.S. PATENT DOCUMENTS 6,588,489 B1 * 7/2003 Vert ..... B22C 9/101 123/195 C
6,871,626 B2 * 3/2005 Kamiyama ..... F01M 11/0004 123/195 C

FOREIGN PATENT DOCUMENTS

DE 102011117435 A1 * 5/2013 ..... F01M 11/0004

* cited by examiner

*Primary Examiner* — Kevin E Yoon
(74) *Attorney, Agent, or Firm* — Harness, Dickey & Pierce, P.L.C.

(57) ABSTRACT

A universal oil pan die tooling is provided for forming alternative oil pans for alternative internal combustion engines with and without an oil cooler circuit. The die tooling includes a first die member defining a cavity and a second die member having a protruding portion designed to be inserted in the cavity of the first die member to define a mold cavity therebetween that defines a shape of the oil pan. A first die insert is used along with the first die member and the second die member to form oil pans for use with an engine having an oil cooler. An alternative second die insert is used in place of the first die insert along with the first die member and the second die member to form oil pans for use with an engine without an oil cooler.

5 Claims, 6 Drawing Sheets

OIL PAN CASTING WITH OPTIONAL OIL COOLER PROVISIONS

FIELD

The present disclosure relates to internal combustion engines and more particularly to an internal combustion engine oil pan casting with optional oil cooler provisions.

BACKGROUND AND SUMMARY

This section provides background information related to the present disclosure which is not necessarily prior art.

Internal combustion engines are lubricated using oil that is collected in an oil pan in the bottom of the crankcase of the internal combustion engine. The oil pan serves as an oil reservoir where the lubrication oil accumulates. Some engines are provided with an oil cooler in order to cool the oil. The oil is withdrawn from the oil pan, runs through the oil pump oil cooler and the cooled oil is then sent through the engine lubrication system and is then returned to the oil pan. Although oil cooled engines are common, it is also common to have engines with no oil cooler. Typically, an engine having an oil cooler has to have a specially designed oil pan in order to port the oil from the engine to a remote oil cooler and back again. Accordingly, engines utilizing an oil cooler have one oil pan design while engines without an oil cooler have a different oil pan design.

The present disclosure provides an oil pan design that can share an oil pan casting tool, and that can be machined and fitted differently to serve in both engine oil cooled and non-oil cooled vehicle applications.

According to one aspect of the present disclosure, a universal oil pan die tooling is provided for forming alternative oil pans for alternative internal combustion engines with and without an oil cooler circuit. The die tooling includes a first die member defining a cavity and a second die member having a protruding portion designed to be inserted into the cavity of the first die member to define a mold cavity therebetween that defines a shape of the oil pan. A first die insert is used along with the first die member and the second die member to form oil pans for use with an engine having an oil cooler. An alternative second die insert is used in place of the first die insert along with the first die member and the second die member to form oil pans for use with an engine without and oil cooler.

According to a further aspect of the present disclosure, the universal oil pan design is provided for use with an internal combustion engine and includes a bottom wall, a sidewall extending from a periphery of the bottom wall and the bottom wall and the sidewall each including an interior surface to define an internal cavity. The top edge of the sidewall defines a mounting flange. A plurality of mounting apertures extend through the mounting flange. First and second bosses are disposed in the outer surface of the oil pan. The first and second bosses are optionally provided with oil cooler supply and return ports therethrough, respectively for connection to an oil cooler for use with an engine having an oil cooler. The oil cooler supply port is in communication with a first recess region in the interior of the oil pan and has an opening extending through the oil pan adjacent to an oil filter fitting. The oil cooler return port is in communication with a second recess-region in the interior of the oil pan. The first and second bosses can remain closed for use with an engine having no oil cooler.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
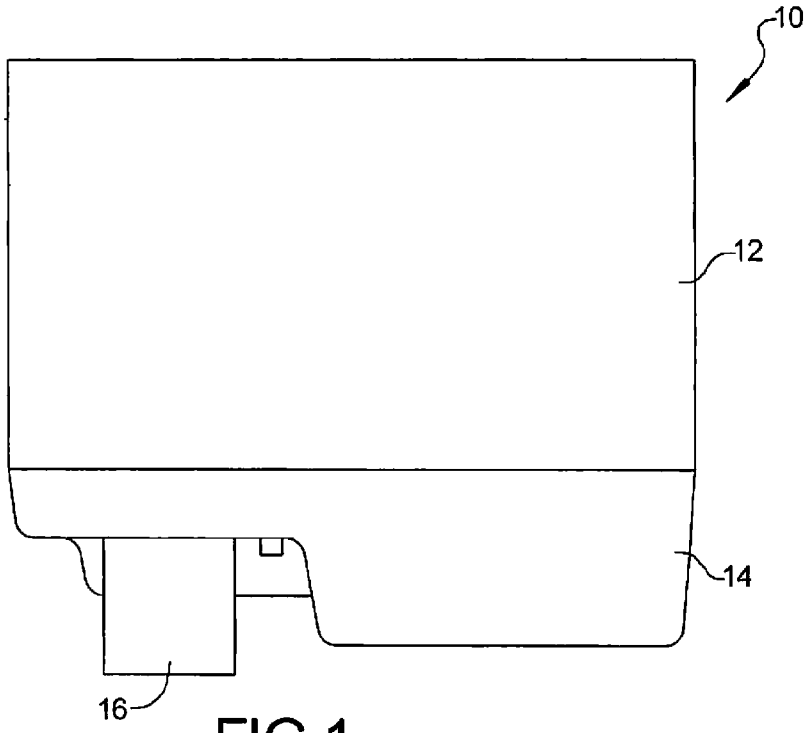
FIG. 1 is a schematic view of an internal combustion engine having an oil pan with no oil cooler porting.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an internal combustion engine 10 is shown including an engine structure 12 that can include a block and a cylinder head, as are generally known in the art. An oil pan 14 is mounted to the engine structure 12. An oil filter 16 is mounted to the oil pan 14. The engine 10 is designed as a non-oil cooled engine, therefore the oil pan 14 does not include any porting for connection to an oil cooler.

Figure 2:
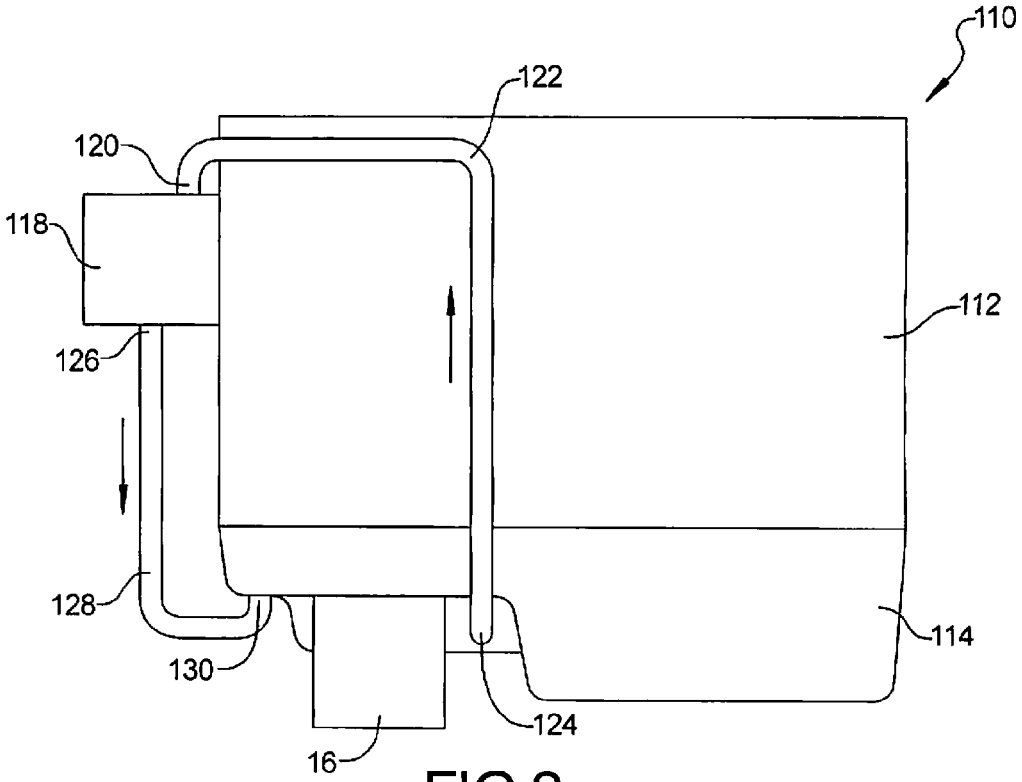
FIG. 2 is a schematic view of an internal combustion engine having an oil pan with oil cooler porting connected to an oil cooler.

With reference to FIG. 2, an internal combustion engine 110 is shown including an engine structure 112 that can include a block and a cylinder head, as are generally known in the art. An oil pan 114 is mounted to the engine structure 112. An oil filter 16 is mounted to the oil pan 114. The engine 110 is designed as an oil cooled engine and includes an oil cooler 118 that can be mounted to the engine structure 112. The oil cooler 118 includes an inlet 120 which is connected to a cooler supply line 122 that is connected to a cooler supply port 124 provided in the oil pan 114. The oil cooler 118 can also include an outlet 126 that is connected to a cooler return line 128 that is connected to a cooler return port 130 provided in the oil pan 114.

According to conventional engine designs, the oil pans for oil-cooled engines and for non-oil cooled engines have required different designs, thereby requiring separate tooling for each type of oil pan. According to the principles of the present disclosure, the oil pan 14 for the non-oil cooled engine 10 is cast in the same die tooling as the oil pan 114 for the oil cooled engine 110. Therefore, a significant cost savings is achieved by forming the oil pans 14, 114 for both non-oil cooled and oil cooled engines using common die tooling, as will be described in detail herein.

Figure 3:
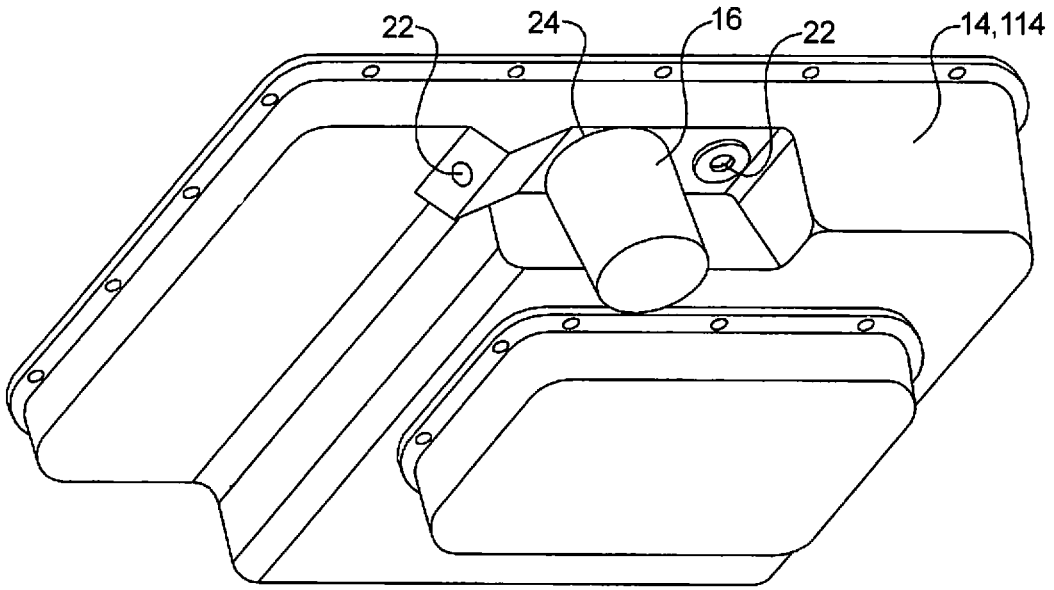
FIG. 3 is a perspective view of an oil pan according to the principles of the present disclosure.

With reference to FIG. 3, the oil pan 14, 114 is generally shown with an oil filter 16 mounted thereto. The exterior surface of the oil pan 14, 114, is provided with a first raised boss region 20 and a second raised boss region 22. The raised boss regions 20, 22 are disposed on opposite sides of a filter mounting region 24 to which the oil filter 16 is mounted. Each of the raised boss regions 20, 22 can be provided with a pin recess 26 that can serve as a guide hole for a drilling operation to be performed on the boss regions if the oil pan is being used with an oil cooler to thereby provide the oil cooler supply port 124 and oil cooler return port 130 of the oil pan 114. It is noted that the pin recesses 26 of the raised boss regions 20, 22 are best shown in FIGS. 4 and 5.

Figure 4:
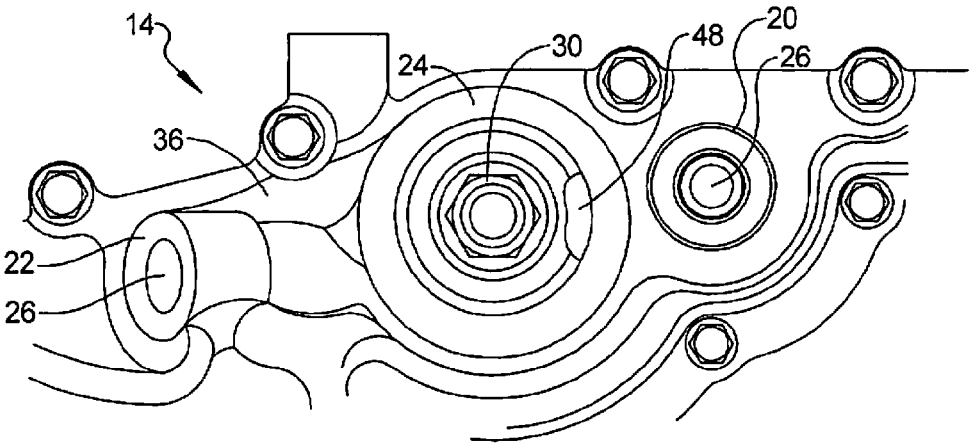
FIG. 4 is a partial perspective view of the oil filter mounting region on the exterior surface of an oil pan for use with non-oil cooled engines.
Figure 5:
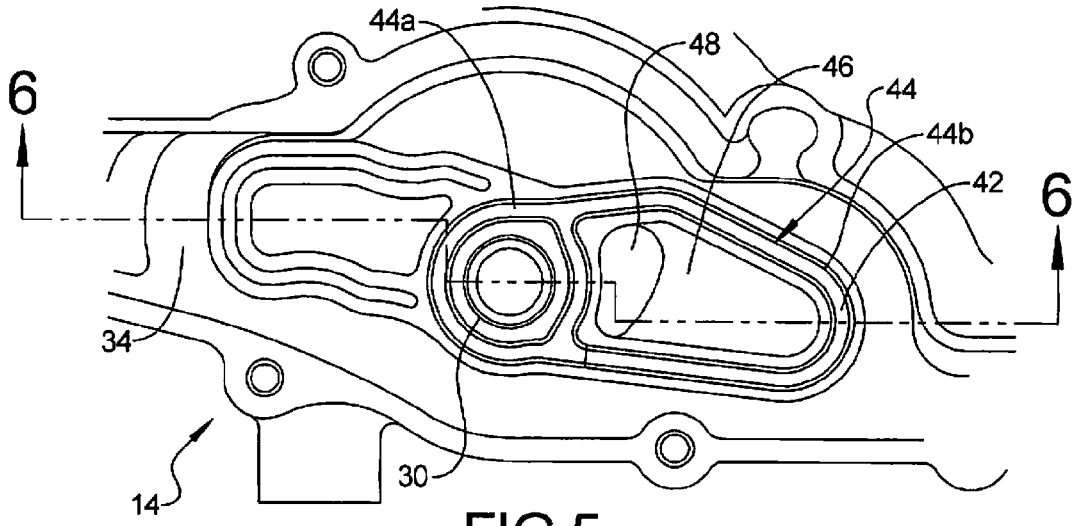
FIG. 5 is a partial perspective view of the oil filter mounting region of the oil pan shown in FIG. 4 for use with non-oil cooled engines.
Figure 6:
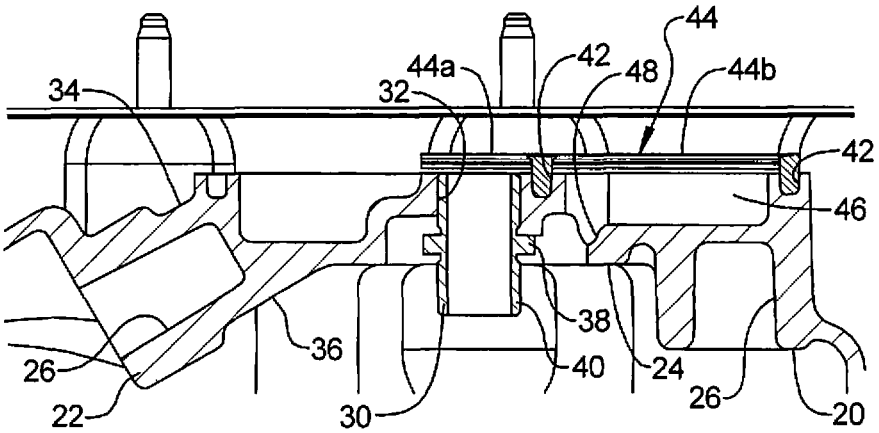
FIG. 6 is a cross-sectional view of the oil filter mounting region of the oil pan shown in FIGS. 4 and 5 taken along line 6-6 of FIG. 5.

With reference to FIGS. 4-6, details of the oil pan 14 for use with a non-oil cooled engine 10 will now be described. As shown in FIG. 4, the oil pan 14 includes the raised boss regions 20, 22 that are on opposite sides of the filter mounting region 24. As shown in FIG. 6, the raised boss regions 20, 22 each include a pin recess 26 therein which are closed on their inboard end because they are not being used for the purpose of defining cooler supply and return ports. FIGS. 4-6 each disclose a threaded fitting 30 that is received in threaded opening 32 in the center of the filter mounting region 24. The opening 32 extends from the interior side 34 to the exterior side 36 of the oil pan 14. The fitting 30 is secured within the opening 32 and on an exterior side 36 of the oil pan 14 can include a hex shaped tool engagement portion 38 and an exterior threaded portion 40. The hex shaped tool engagement portion 38 allows the fitting 30 to be threadedly engaged in the threaded opening 32. The exterior threaded portion 40 of the fitting 30 provides a threaded connection for connection to an interior thread of the oil filter 16 as is known in the art.

In the assembled position, the oil filter 16 includes a gasket (not shown) that engages the annular filter mounting region 24, shown in FIG. 4. On the interior surface 34 of the oil pan 14, a recessed groove 42 is provided for receiving a gasket 44 therein. The gasket 44 includes a first section **44*a* that surrounds the fitting 30 and a second section 44*b* that surrounds a recessed region 46 that defines a supply passage to an opening 48 that supplies oil to the oil filter 16. An oil pump (not shown) is connected to the oil pan 14 on the interior surface 34 and seals against the gasket 44. As is known in the art, the oil pump draws oil from a lowest portion of the oil pan through the oil pump, into the recess 46 through the passage 48 and into the filter 16. The oil is then passed through the filter 16 and then through the fitting 30** and the filtered oil is then delivered to the engine components for lubrication thereof.

Figure 7:
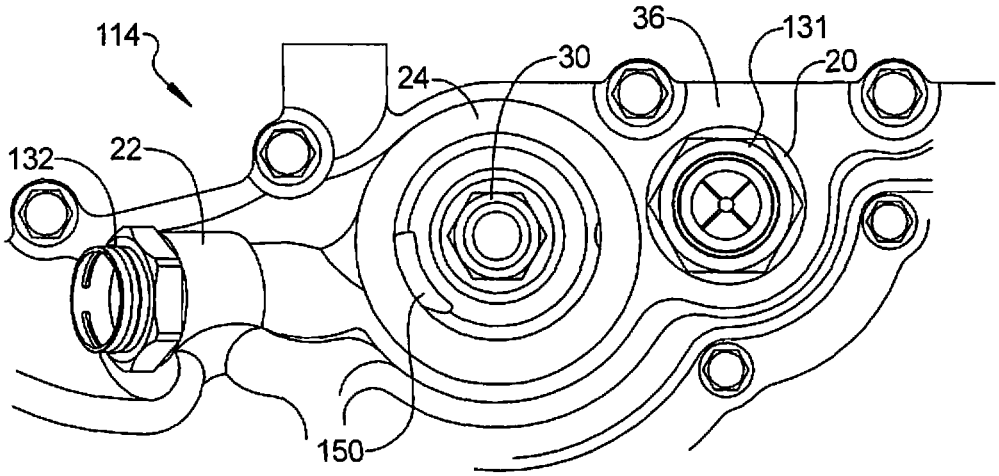
FIG. 7 is a partial perspective view of the exterior surface of the oil filter mounting region of the oil pan for use with oil cooled engines.
Figure 8:
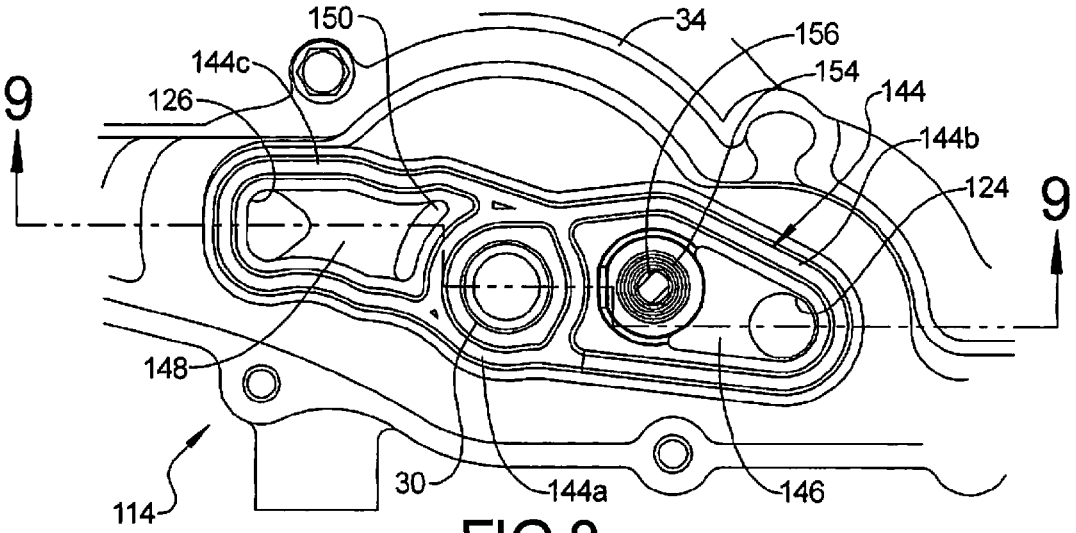
FIG. 8 is a partial perspective view of the interior surface of the oil filter mounting region of the oil pan for use with oil cooled engines.
Figure 9:
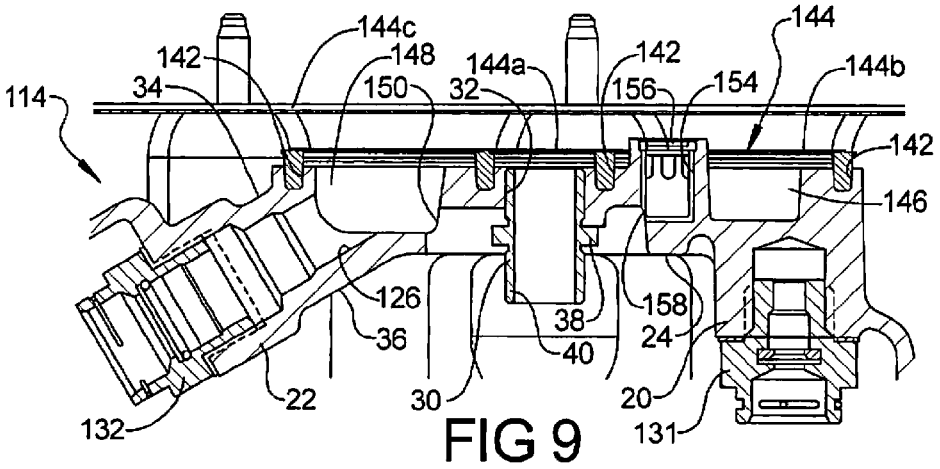
FIG. 9 is a cross-sectional view of the oil filter mounting region of the oil pan shown in FIGS. 7 and 8 taken along line 9-9 of FIG. 8.

With reference to FIGS. 7-9, details of the oil pan 114 for use with an oil cooled engine 110 will now be described. As shown in FIG. 7, the oil pan 114 includes the raised boss regions 20, 22 that are on opposite sides of the filter mounting region 24. As shown in FIGS. 8 and 9, the raised boss regions 20, 22 have each been drilled out to define an oil cooler supply port 124 through the raised boss region 24 and an oil cooler return port 126 through the raised boss region 22. It is noted that the oil cooler supply port 124 is best shown in FIG. 8 while the cross-section of FIG. 9 is not cut directly through the oil cooler supply port so that the entire opening 124 is not clearly shown in that view. As shown in FIGS. 7 and 9, an oil cooler supply fitting 131 is provided in the oil cooler supply port 124 and an oil cooler return fitting 132 is provided in the oil cooler return port 126.

FIGS. 7-9 each disclose a threaded fitting 30 that is received in an opening 32 in the center of the filter mounting region 24. The opening 32 extends from the interior side 34 to the exterior side 36 of the oil pan 114. The fitting 30 is threadedly secured within the opening 32 and on an exterior side 36 of the oil pan 114 can include a hex shaped tool engagement portion 38 and an exterior threaded portion 40. The hex-shaped tool engagement portion 38 allows the fitting 32 to be threadedly engaged in the opening 32. The exterior threaded portion 40 provides a threaded connection for connection to an interior thread of the oil filter 16, as is known in the art.

In the assembled position, the oil filter 16 includes a gasket (not shown) that engages the annular filter mounting region 24, shown in FIG. 7. On the interior surface 34 of the oil pan 114, a recessed groove 142 is provided for receiving a gasket 144 therein. The gasket 144 includes a first section 144*a* that surrounds the fitting 30, a second section 144*b* that surrounds a first recess region 146 and a third section 144*c* that surrounds a second recess region 148.

An oil pump (not shown) is connected to the interior surface 34 of the oil pan 114 and seals against the gasket 144. As is known in the art, the oil pump draws oil from a lowest portion of the oil pan through the oil pump, into the recess 146 through the oil cooler supply port 124, through the oil cooler supply line 122, through the oil cooler 118, through the oil cooler return line 128, through the oil return port 130 and into the second recessed region 148. The second recessed region 148 is provided with an opening 150 that is in communication with the oil filter 16. Oil passes through the opening 150 into the oil filter 16 and out through the fitting 30 where the filtered oil is then supplied to the various engine components for lubrication thereof.

As shown in FIGS. 8 and 9, the interior surface 34 of the oil pan 114 includes a recess 154 for receiving a bypass valve 156 that is in communication with an opening 158 that is in communication with the oil filter 16.

With the exception of the following differences, the oil pans 14, 114 are generally identical and are formed within the same tooling. The oil pan 14 includes a recessed gasket region 42 that only surrounds the fitting 30 and the recess 46 for receiving the gasket 44. In the oil pan 114, the recessed gasket region surrounds the fitting 30, a first recess 146 and a second recess 148 for receiving the gasket 144.

In the oil pan 14, an opening 48 is provided between the interior recess 46 and the exterior side 36 of the oil pan 14 and within the oil filter mounting region 24. In the oil pan 114, the first recess 146 is provided with a bypass valve 156 in an opening 158 between the recess 146 and the exterior side 36 of the oil pan 114 and within the oil filter mounting region 24.

In the oil pan 14, each of the raised boss regions 20, 22 remain closed. In the oil pan 114, each of the raised boss portions 20, 22 are drilled out or machined to provide a passage through the oil pan 114 from the exterior side 36 to the interior side 34 of the oil pan 114. The raised boss portions 20, 22 serve as an oil cooler supply port 124 and an oil cooler return port 130, respectively for use of the oil pan 114 for an engine 110 having an oil cooler 118. In the oil pan 114, the second recess 148 is provided with an opening 150 that communicates with the oil filter 16. The oil pan 14 does not include a gasket-surrounded second recess like the oil pan 114.

Figure 10:
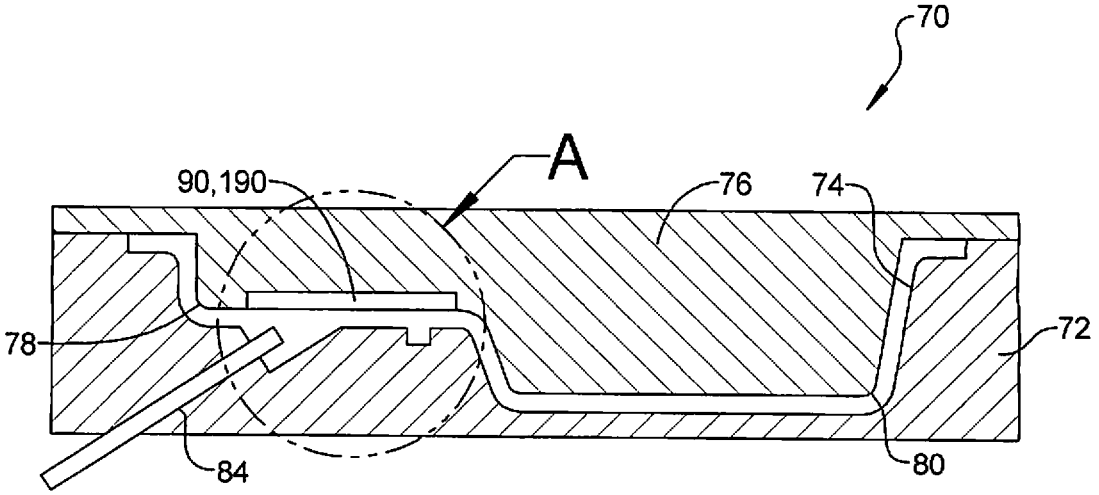
FIG. 10 is a schematic diagram of an oil pan die tooling according to the principles of the present disclosure.
Figure 11:
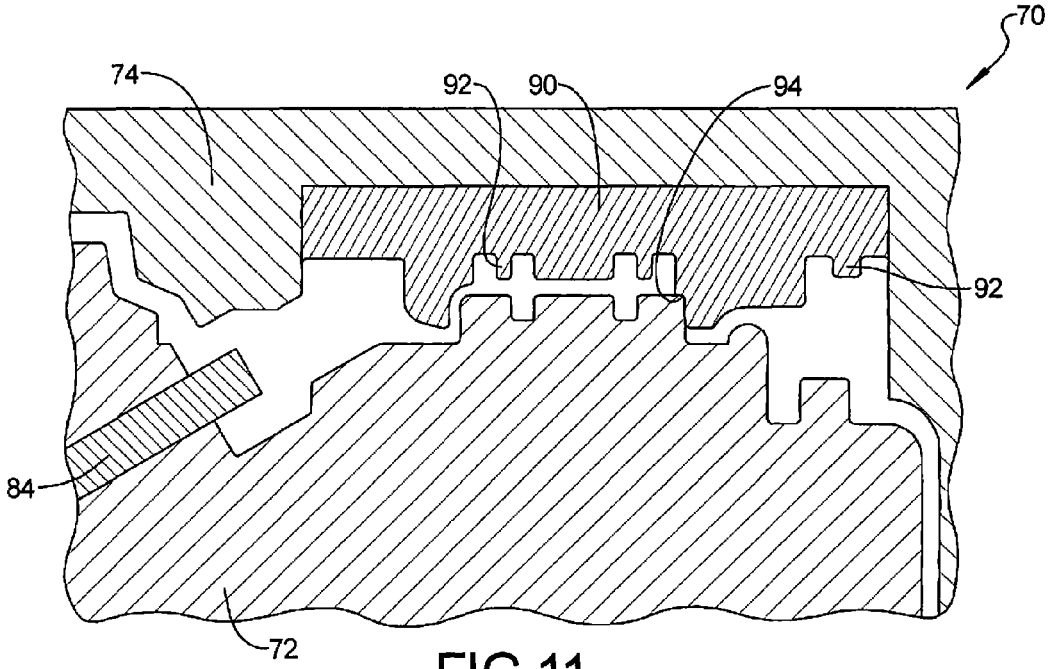
FIG. 11 is a detailed cross-sectional view of the die tooling region identified by circle A in FIG. 10 showing an exemplary die insert for making oil pans for non-oil cooled engines.
Figure 12:
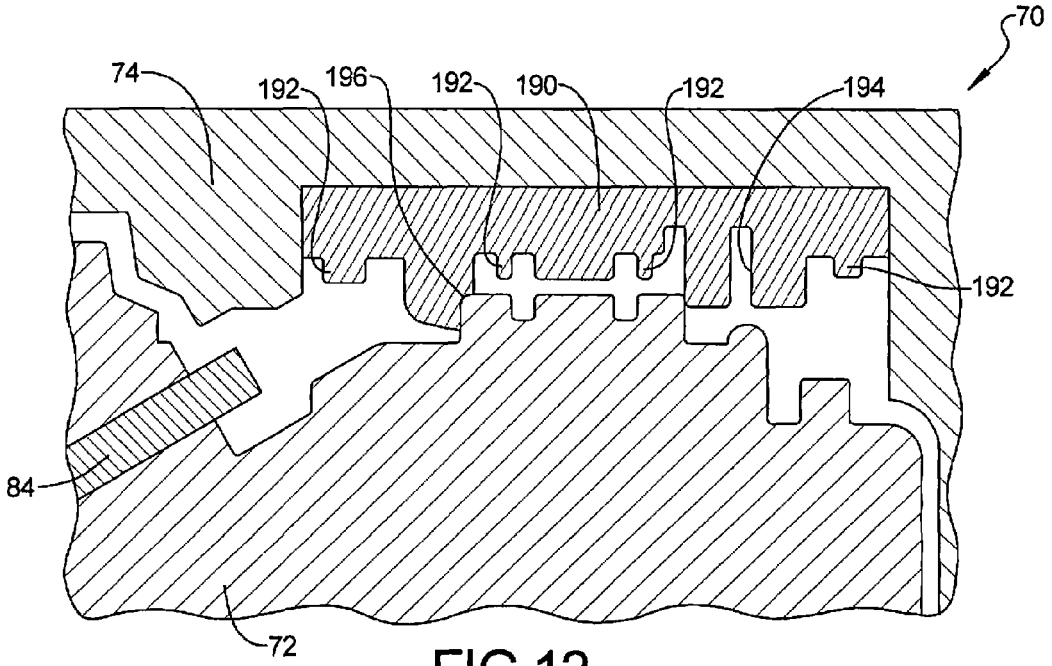
FIG. 12 is a detailed cross-sectional view of the die tooling region identified by circle A in FIG. 10 showing an exemplary die insert for making oil pans for oil cooled engines.

With reference to FIGS. 10-12, the alternative oil pans 14, 114 are made using a universal oil pan die tooling 70. The universal oil pan die tooling 70 includes a first die member 72 defining a cavity 74. A second die member 76 includes a protruding portion 78 that is inserted into the cavity 74 of the first die member 72 in order to define a mold cavity 80 the generally defines a shape of the oil pans 14, 114. A pair of alternative die inserts 90, 190 are attached to the second die member 76 depending upon whether the universal oil pan die tooling 70 is being used for making the oil pan 14 for use with an engine 10 without oil cooling or for making the oil pan 114 for use with an engine 110 having oil cooling. A slide insert 84 can be used to form the angled pin recess 26 in the second raised boss portion 22. The slide insert 84 is inserted at an angle through the first die member 72 and is removed from a mold cavity prior to the removal of the molded oil pan 14, 114.

With reference to FIG. 11, the universal oil pan die tooling 70 is shown with the die insert 90 for making the oil pan 14 for use with an engine without oil cooling. In the die insert 90, the insert 90 includes protruding regions 92 that define the gasket recess 42 that only surrounds the fitting 30 and the recessed region 46. In addition, the first die insert 90 includes a contact portion 94 that contacts the first die member 72 for defining the opening 48 between the recess 46 on the interior side 34 and extending through to the exterior side 36 of the oil pan 14.

With reference to FIG. 12, the universal oil pan die tooling 70 is shown with the die insert 190 for making the oil pan 114 for use with an engine 110 with oil cooling. In the die insert 190 a protruding region 192 is provided that defines the gasket recess 142 that surrounds the fitting 30, the first recessed region 146 and the second recessed region 148. In addition, die insert 190 includes an annular recess portion 194 that defines a cavity portion for defining the raised boss that defines the opening 154 that receives the bypass valve 156. The die insert 190 also defines a contract region 196 that contacts the first die member 72 for defining the opening 150 that communicates between the second recess 148 on the interior side 34 of the oil pan 114 to the exterior side 36.

Accordingly, by utilizing the universal oil pan die tooling 70 with alternative die inserts 90, 190, the universal oil pan die tooling 70 can be used for making oil pans that can be used for engines that do not include oil cooling and for engines that do include oil cooling. Accordingly, the present disclosure provides two oil pan designs 14, 114 that share an oil pan casting tool 70 which can be machined and fitted differently to serve in both engine oil cooled and non-cooled vehicle applications.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. Universal oil pan die tooling for forming alternative oil pans for alternative internal combustion engines with and without an oil cooler circuit, the die tooling comprising:

a first die member defining a cavity;

a second die member having a protruding portion, said protruding portion designed to be inserted in the cavity of the first die member to define a mold cavity therebetween defining a shape of the oil pan;

a first die insert used along with the first die member and the second die member to form oil pans adapted for use with an engine having an oil cooler; and a second die insert, different than the first die insert, and used along with the first die member and the second die member for forming oil pans adapted for use with an engine without an oil cooler, wherein the first die insert and the second die insert are used with the first die member and the second die member one at a time.

2. The universal oil pan die tooling according to claim 1, further comprising a slide insert inserted into the mold cavity through the first die member.

3. The universal oil pan die tooling according to claim 1, wherein said first die insert includes a first protruding portion surrounding an area forming a filter inlet passage and a cooler return port for defining a first recessed gasket groove on an interior surface of the oil pans adapted for use with an engine having an oil cooler.

4. The universal oil pan die tooling according to claim 3, wherein said first die insert includes a second protruding portion surrounding an area for forming a cooler supply passage for defining a second recessed gasket groove on the interior surface of the oil pans adapted for use with an engine having an oil cooler.

5. The universal oil pan die tooling according to claim 4, wherein said second die insert includes a third protruding portion surrounding an area for forming a filter inlet passage for defining a third gasket groove on the interior surface of the oil pans adapted for use with an engine without an oil cooler.

* * * * *